US007159721B2

(12) United States Patent
Martin, Jr.

(10) Patent No.: US 7,159,721 B2
(45) Date of Patent: Jan. 9, 2007

(54) POINT OF PURCHASE DISPLAY CONTAINER

(76) Inventor: Tim Martin, Jr., P.O. Box 649, Lynden, WA (US) 98249

( * ) Notice: Subject to any disclaimer, the term of this patent is extended or adjusted under 35 U.S.C. 154(b) by 278 days.

(21) Appl. No.: 10/747,971

(22) Filed: Dec. 29, 2003

(65) Prior Publication Data

US 2004/0195147 A1 Oct. 7, 2004

Related U.S. Application Data

(60) Provisional application No. 60/437,682, filed on Dec. 31, 2002.

(51) Int. Cl.
*B65D 5/50* (2006.01)
*B65D 85/00* (2006.01)

(52) U.S. Cl. ..... 206/765; 206/485; 206/526

(58) Field of Classification Search ..... 206/485, 206/526, 525.1, 736, 756, 758, 765
See application file for complete search history.

(56) References Cited

U.S. PATENT DOCUMENTS

| | | | | |
|---|---|---|---|---|
| 3,164,430 | A | 1/1965 | Beem et al. | |
| 3,351,182 | A * | 11/1967 | Greer et al. | 206/758 |
| 3,756,385 | A * | 9/1973 | Steinbock | 206/526 |
| 4,485,922 | A * | 12/1984 | Desmond et al. | 206/485 |
| 5,121,838 | A * | 6/1992 | Dickie | 206/485 |
| 5,165,534 | A | 11/1992 | Kaufman et al. | |
| 5,819,922 | A | 10/1998 | Martin, Jr. | |
| 5,979,662 | A * | 11/1999 | Green | 206/526 |
| 6,367,632 | B1 * | 4/2002 | Green | 206/764 |

* cited by examiner

*Primary Examiner*—Luan K. Bui
(74) *Attorney, Agent, or Firm*—George C. Rondeau, Jr.; Davis Wright Tremaine LLP

(57) ABSTRACT

A method of making a point of purchase display container including folding a sheet of resilient material having a series of fold markings and cut lines into the shape of a product container. A product container including a plurality of resilient members for association with a product that can be contained, displayed, and/or transported in the product container.

19 Claims, 3 Drawing Sheets

POINT OF PURCHASE DISPLAY CONTAINER

This application claims priorty of provisional application No. 60/437,682, filed on Dec. 31, 2002.

BACKGROUND

The present invention is directed to a point of purchase container apparatus. In particular, the invention is directed to a point of purchase display container which allows for the easy transport of products and the arrangement of the product container on a display board or peg board in a variety of positions.

The present invention relates in general to a point of purchase container apparatus and, in particular, to a peg board point of purchase container apparatus that can be used for not only displaying articles on a peg board, on a warehouse or retail outlet shelf, but also for the packaging, storage and transportation of the same articles during shipment.

Containers convertible from storage and transporting articles towards acting as point of purchase display units have been used for many years. Such early containers were nothing more than a box with a removable and detachable lid, such as a conventional shoe box. If the articles in the container were to be displayed, the lid would be removed and then either attached to the bottom of the container or discarded.

While functional, such arrangements did not present the articles being displayed in the most effective "merchandising" fashion. These prior art display containers would normally lie flat, horizontally on the counter or shelf. One could not vertically stack the display containers or the articles contained in the lower display container would be hidden from view. Moreover, very often the covers for the containers would become lost or misplaced.

Other display containers have been developed in which the covers or lids are attached. During the transformation from storage and transportation to point of purchase display, the cover of such prior art containers, roll back and underlie the lower displaying portion of the container. This arrangement allowed the lower displaying portion to be placed on an angle for a more pleasing presentation of the articles within the container. While providing a better display of the articles, these types of container apparatus could still not be restrainably stacked, either vertically or horizontally unless the view of the articles within the lower container was obscured. Likewise, attempts to stack often resulted in toppling, breakage or separation or displayed goods and the like.

Retailers commonly use what is known as a peg board for displaying merchandise. A peg board is a vertical panel having a regular pattern of holes in it. The holes in the peg board are used for suspending prongs, rods or the like, for hanging the merchandise for display.

It is thus an object of the present invention to create an inexpensive, easy to assemble point of purchase container apparatus that can be utilized not only for the display of articles but that can also be utilized in the packaging, storage and transportation of such articles.

It is a further object of the invention to provide a point of purchase container apparatus that may be stacked on a peg board or shelf, not only horizontally but also vertically in a substantially stable manner while permitting a substantially un-obscured view of at least a portion of the articles within not only the top container but the lower stacked upon containers as well.

These and other objects of the invention will become apparent in light of present specification and drawings.

SUMMARY OF THE INVENTION

The present invention is a point of purchase display product container and a method for making a product container adapted to retain and display products.

In one embodiment, the product container includes a plurality of deformable, resilient upper retention members projecting from an upper rim; an inner and outer side wall congruent with the upper rim; a plurality of deformable, resilient partial rings formed in the inner side wall; a base supporting the inner side wall and the outer side wall; a plurality of deformable, resilient lower retention members forming an angle extending from the base; a distal and proximal end of the product container; a sleeve formed by the intersection of the inner side wall, the outer side wall, and the upper rim; and a stop in the upper rim toward the distal end of the product container. The product container may be in a tipped or stopped position.

A method for making a product container is disclosed. The method includes folding a sheet including cut lines and fold lines for a product container by folding along the folding points and securing a plurality of flaps into a center cut using an adhesive, inserting products into a plurality of openings formed between resilient members; sliding the product container onto at least a rigid rod connected to a display board by inserting the rods through a sleeve of the product container; and pushing the product container toward the connected end of the rod until the tip of the rod rests in a stop in the sleeve of the product container. The product container can then assume a secured stopped or tipped position.

One advantage of the product container is that is can be temporarily or permanently attached to existing display schemes. The product container can accommodate a number of products simultaneously for storage or display. The container can also be displayed in a tipped position. The product container may initially be fully inserted on the prongs. As the product container empties of product, the product container can be pushed away from the peg board. The product container would assume a titled downward position so as to facilitate removal of products located more closely toward the peg board.

Another advantage of the product container is the time saving aspect of having the products arrive at the retail outlet ready to be placed on display by association of the product container containing product with the peg board rather than each individual product having to be associated with the peg board. In this manner, a plurality of products contained in the product container can be associated with a peg board and placed on display in minutes rather than the longer time it would take to associate individual products with the peg board.

The invention will best be understood by reference to the following detailed description of the preferred embodiment, taken in conjunction with the accompanying drawings. The discussion below is descriptive, illustrative and exemplary and is not to be taken as limiting the scope defined by any appended claims.

DETAILED DESCRIPTION OF THE PREFERRED EMBODIMENT

Figure 1:
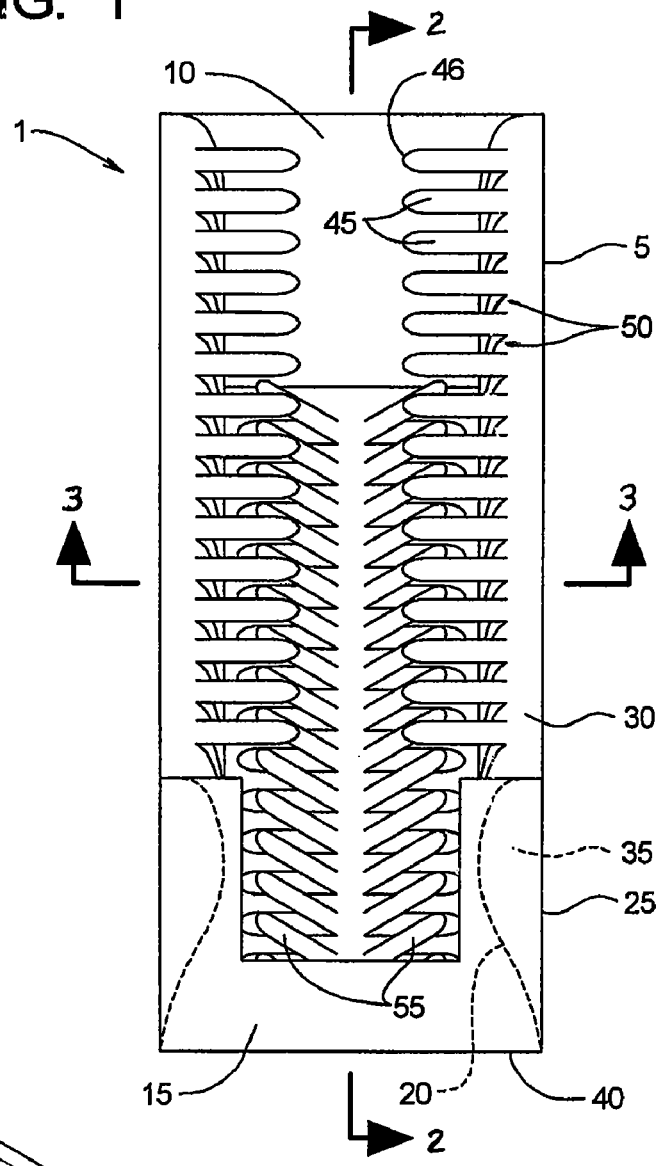
FIG. 1 is a perspective view of one embodiment of the product container.

As shown in FIG. 1, the point of purchase product container 1 can be box-like. It is generally rectangular or square in shape, although product containers 1 having rounded or oval shapes are envisioned. The product container 1 may be constructed of any material such as metal, plastic, wood, or paper. In one aspect, the product container 1 is constructed of resilient plastic. The product container 1 may be clear allowing full or partial viewing of the products container therein or may be opaque allowing limited to no viewing of the products container therein.

The product container 1 has generally parallel side walls 5, a distal end 10 and a proximal end 15. The side wall 5 is comprised of an inner side wall 20 and an outer side wall 25. The side walls 5 are connected at an upper rim 30. The space between the inner side wall 20, the outer side wall 25 and the upper rim 30 form a sleeve or channel 35. In another embodiment, the sleeve 35 can be formed as a further extension of the upper rim 30. A base 40 supports the inner side wall 20 and the outer side wall 25.

In one embodiment, the product container includes a plurality of deformable, resilient upper retention members 45. The upper retention members 45 are generally finger like projections. In one aspect, the retention members 45 have a rounded free end 46. The plurality of upper retention members 45 project from the upper rim 30. In one embodiment of the product container 1, the upper retention members 45 are arranged in a regular array. In another embodiment, the upper retention members 45 are arranged in an irregular array. The upper retention members may be located along the entire upper rim 30 or only a portion of the upper rim 30. The upper retention members 45 may or may not be opposing or they may be opposing for a portion of the upper rim 30. The manner of arrangement of the upper retention members 45 can be highly variable.

Figure 2:
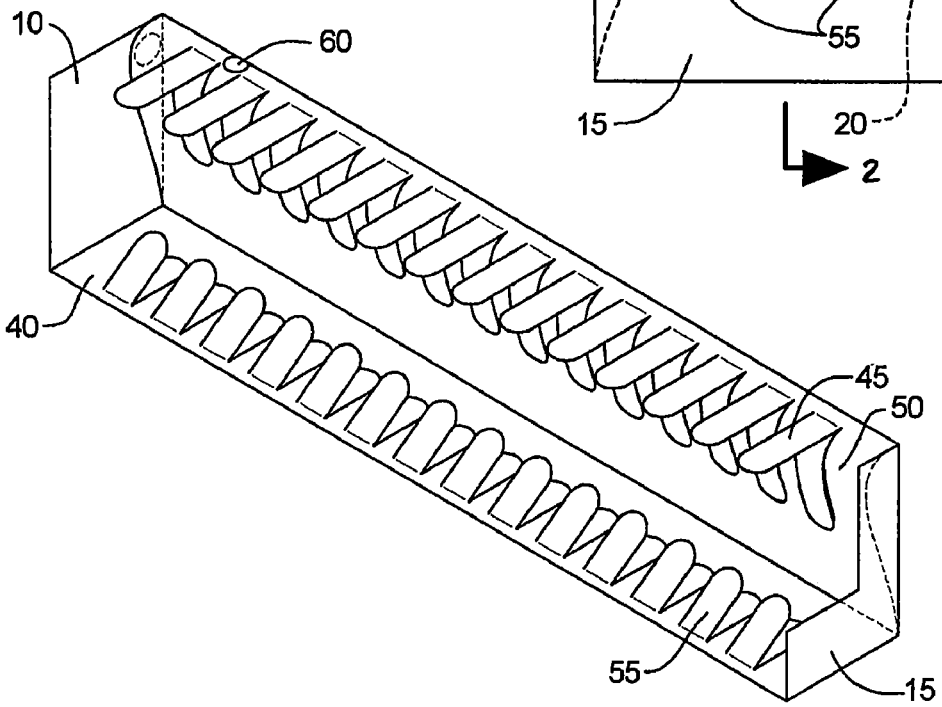
FIG. 2 is a cross section along line A—A of FIG. 1 showing one embodiment of the product container including upper retention members, lower retention members and partial rings.

As shown in FIGS. 1 and 2, from the inner side wall 20 a plurality of deformable, resilient partial rings 50 are formed and comprise a plurality of side retention members projecting from the inner side wall. The side retention members are vertical camber shaped projections. The partial rings 50 are formed from the upper retention member 45 cut-outs in the resilient sheet 75. In one embodiment of the product container 1, the partial rings 50 are arranged in a regular array. In another embodiment, the partial rings 50 are arranged in an irregular array. The partial rings 50 may be located along the entire side wall 20 or only a portion of the side wall 20. The upper partial rings 50 may or may not be opposing or they may be opposing for a portion of the side wall 20. The manner of arrangement of the partial rings 50 can be highly variable.

Figure 3:
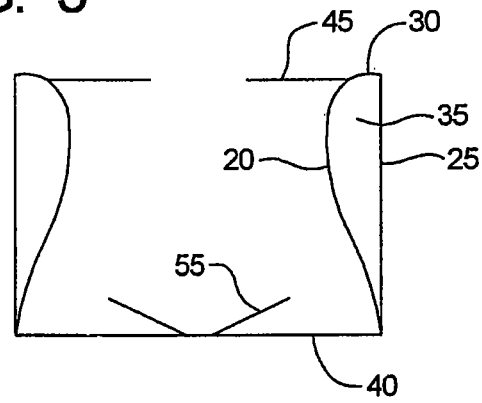
FIG. 3 is a cross section along line B—B of FIG. 1 showing one embodiment of the product container including upper retention members, lower retention members and a sleeve.
Figure 4:
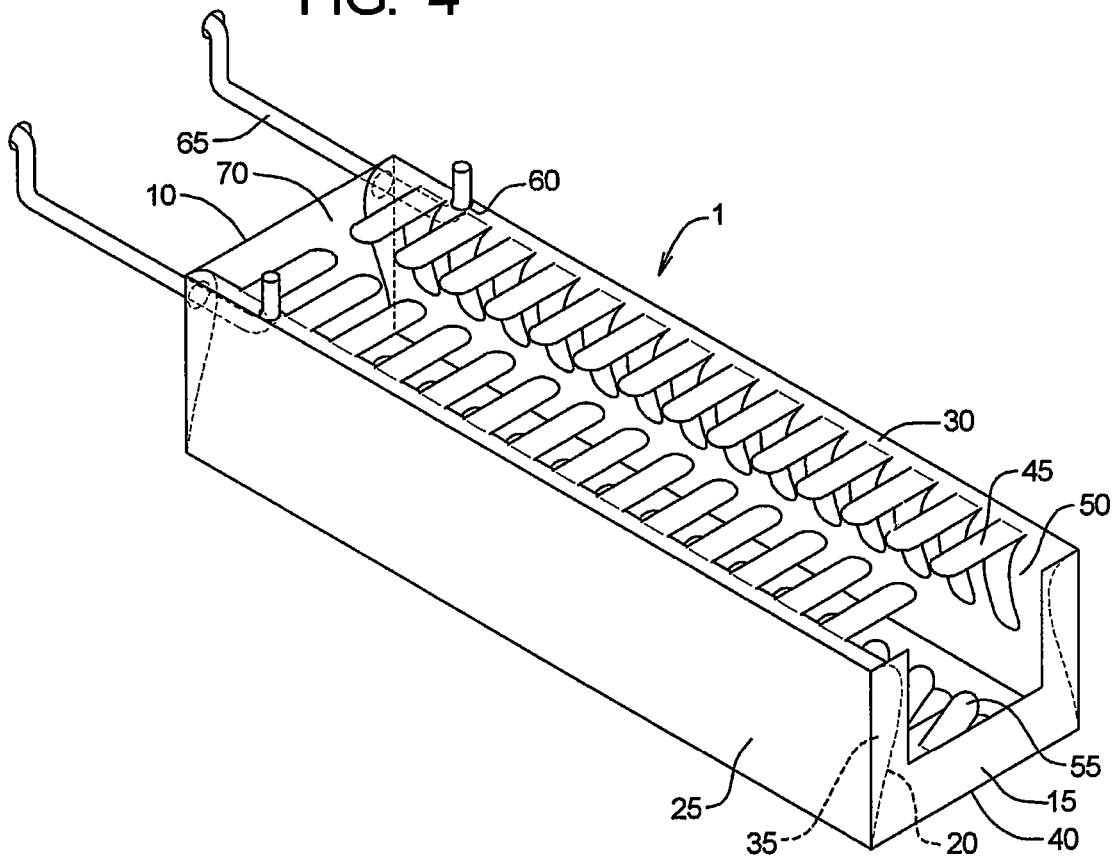
FIG. 4 is a perspective view of one embodiment of the product container in a titled downward position and in association with a display board.

As shown in FIGS. 1–3, a plurality of deformable, resilient lower retention members 55 extend from the base 40. In one aspect, the lower retention members 55 have rounded ends. They may form an angle with the base 40 from about zero degrees to about ninety degrees. As shown in FIGS. 3 and 4, the lower retention members 55 may form opposing fingers in an approximately "V" shape. In one embodiment of the product container 1, the lower retention members 55 are arranged in a regular array. In another embodiment, the lower retention members 55 are arranged in an irregular array. The lower retention members 55 may be located along the entire base 40 or only a portion of the base 40. The lower retention members 55 may or may not be opposing or they may b e opposing for a portion of the base 40. The manner of arrangement of the lower retention members 55 can be highly variable.

As shown in FIG. 3, a stop or seat 60 for a prong or rod 65 is located in the upper rim 30 of the product container 1. The rod or prong 65 may be rigid. In one aspect, a seat 60 is located generally toward the proximal end 15 of the product container 1. As shown in FIG. 4, the prong 65 can be inserted into the sleeve 35 from the distal end 10 of the product container 1. The prong 65 can come to rest or sit in the stop 65. The association or engagement of the prong 65 with the stop 60 assists in securely associating the product container 1 and the prong 65. The prong 65 may then be inserted into a peg board. Alternatively, the prong 65 may first be associated with the peg board and then with the product container 1. In another aspect, the association of the prong 65 with the stop 60 allows for the product container 1 to be pushed forward from the peg board and for the product container 1 to tilt downward from the prong 65. In this tilted down aspect, the prong 65 is associated securely with the stop 60.

If the prong 65 is rigid, the prong 65 may aid in giving and maintaining the shape of the product container 1. The rigidity of the prong 65 adds support to the sides of the product container 1.

An item or product can be inserted into the product container 1 through the opening 70 generally opposite the base 40. In one aspect, the product is inserted in the space created between each upper retention member 45. In an alternative aspect, the product is inserted in the space created between each lower retention member 55. In yet a further aspect, the product may be inserted in the aligned space created between each upper retention member 45 and each lower retention member 55. In this manner, the product rests against the upper retention member 45 and lower retention member 55. By resting against the retention members 45, 55, the product is held generally upright in the product container 1. If the retention members 45, 55 are uniformly spaced, the products can also be uniformly spaced one from the other by placing them in each aligned space formed by the retention members 45, 55.

The resilient upper retention members 45 are generally in alignment with the lower resilient retention members 55. Therefore, the space between any two upper retention members 45 should generally coincide with the space formed between any two lower retention members 55. A product inserted into the coinciding space between upper retention members 45 and lower retention members 55 will sit in the space generally upright. In one aspect, the product may be inserted into non-coinciding spaces so that the product sits at a tilt in the product container 1. The portion of the product that extends from the product container 1 may tilt toward the proximal end 15 or toward the distal end 10 of the product container 1.

During transport, products can be inserted and maintained in the product container 1 in any manner, for example titling, generally upright, or randomly in the product container 1. Once inserted into the product container 1, the products and the product container 1 can be enclosed in shrink wrap or other packaging material, such as but not limited to foil, plastic, and/or paper. The products and product container 1 may be entirely or partially enclosed in the packaging material. In the aspect enclosed in shrink wrap, the shrink wrap is heated so that it cures snuggly around the products and product container 1 maintaining the products in the product container 1 for transport or storage. When it is desirous to use the shrink-wrapped products in the product container 1, the shrink wrapping may be removed. The products may be removed and utilized or they may be placed on display.

In another embodiment, the product container 1 has upper retention members 45 and does not have lower retention members 55. Absence of all or some of the lower retention members 55 may cause the product held in the product container 1 to be arranged and held in a less orderly manner.

In yet another embodiment, the product container has lower retention members 55 and does not have upper retention members 45. Absence of all or some of the upper retention members 45 may cause the product held in the product container 1 to be arranged and held in a less orderly manner.

A method for making a product container 1 is disclosed. In one embodiment, the method of making a product container 1 includes obtaining a sheet of resilient material 75 and stamping a pattern for the display container 1 from the resilient material 75. The resilient material 75 is folded into the product container 1.

Figure 5:
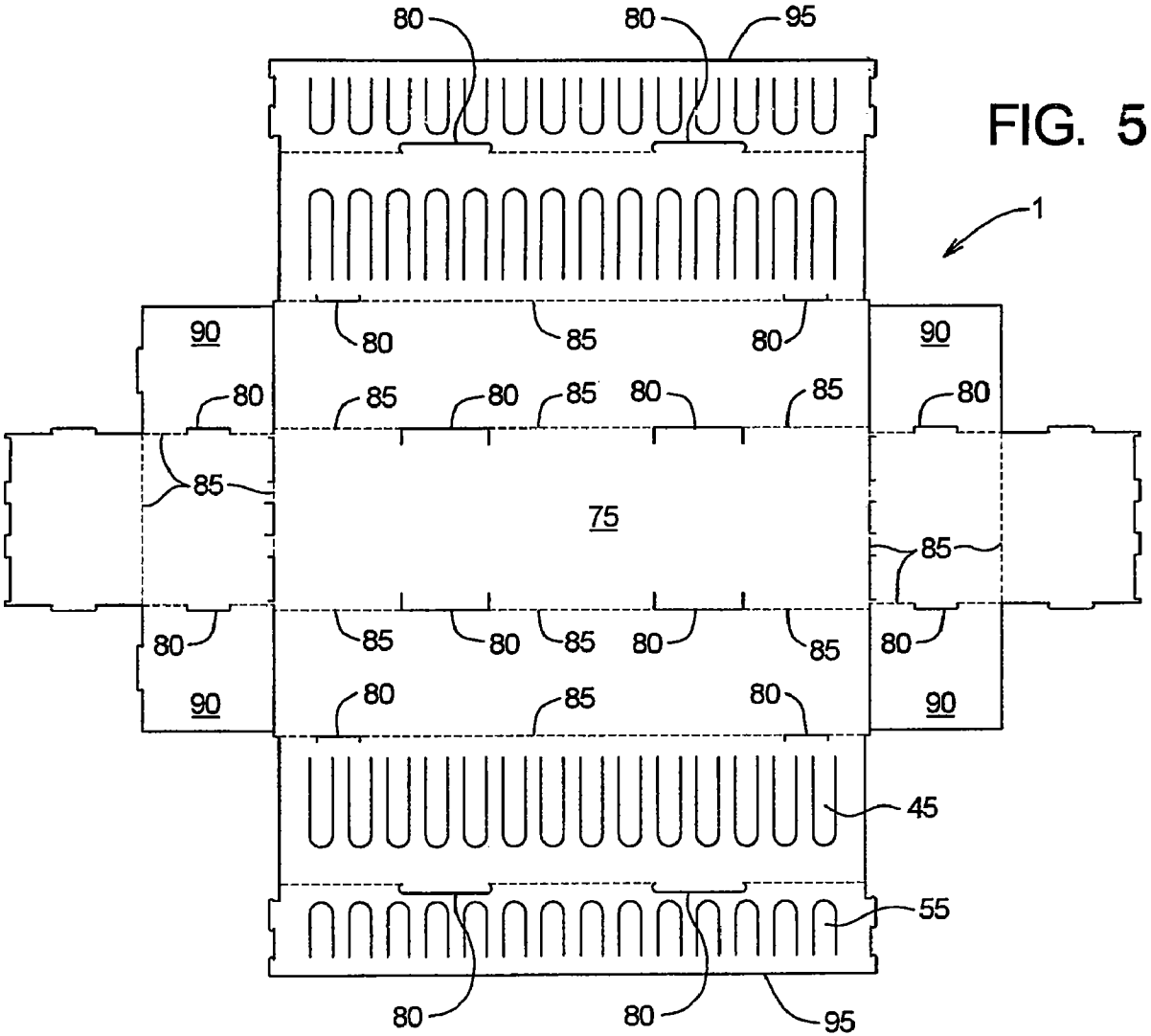
FIG. 5 is a top view of one embodiment of the resilient material used to make the product container showing a plurality of cuts, fold lines, cut outs for the upper retention members and lower retention members, and flaps.

In one aspect, as shown in FIG. 5, the method includes folding a sheet 75, including cut lines 80 and fold lines 85 for a product container 1, by folding along the folding points. The sheet 75, when cut, forms a plurality of flaps 90. The sheet also has a center cut 95. The flaps 90 are secured into the center cut 95 using an adhesive, stable, or any known securement mechanism in the art. Products are inserted into the plurality of spaces formed between upper resilient members 45 and/or lower resilient members 55. The product container 1 is slid onto a rod or prong 65 connected to a peg board or display board by inserting the rod 65 through a sleeve 35 of the product container 1.

No license is expressly or implicitly granted to any patent or patent applications referred to or incorporated herein. The discussion above is descriptive, illustrative and exemplary and is not to be taken as limiting the scope defined by any appended claims.

I claim:

1. A product container comprising;

a plurality of deformable, resilient upper retention members, the retention members having a rounded free end;

an upper rim, the plurality of upper retention members projecting from the upper rim;

an inner side wall congruent with the upper rim;

a plurality of deformable, resilient partial rings formed in the inner side wall;

an outer side wall congruent with the upper rim;

a base supporting the inner side wall and the outer side wall;

a plurality of deformable, resilient lower retention members having rounded ends forming from a zero degree to a ninety degree angle extending from the base;

a distal end of the product container having a distal wall congruent with the base and the inner side walls; a proximal end of the product container having a proximal wall congruent with the base and the inner side walls;

a sleeve formed by the intersection of the inner side wall, the outer side wall, and the upper rim; and a stop in the upper rim toward the distal end of the product container wherein a display prong engageable with the stop allows the container to be in a tipped position.

2. A product container comprising;

a plurality of resilient upper retention members;

an upper rim, the plurality of upper retention members projecting from the upper rim;

at least an inner side wall congruent with the upper rim;

a plurality of side retention members projecting from the inner side wall;

an outer side wall congruent with the upper rim;

a base supporting the inner side wall and the outer side wall;

a plurality of lower retention members connected to the base; a distal wall congruent with the base and the inner side walls;

a proximal wall congruent with the base and the inner side walls; a sleeve formed by the inner side wall and the outer side wall; and a stop in the upper rim.

3. The container of claim 2, wherein the upper retention members are arranged in an array.

4. The container of claim 3, wherein the array is about equally spaced apart.

5. The container of claim 3, wherein the upper retention members have a rounded free end.

6. The container of claim 2, wherein the upper retention members are about parallel to the base.

7. The container of claim 2, wherein the plurality of side retention members are vertical camber shaped projections.

8. The container of claim 2, wherein the plurality of side retention members are about equally spaced partial rings.

9. The container of claim 2, wherein the plurality of side retention members are about equally spaced vertical camber shaped projections.

10. The container of claim 2, wherein the plurality of lower retention members are deformable, resilient, about equally spaced apart opposing fingers forming a zero to ninety degree angle with the base.

11. The container of claim 10, wherein the opposing fingers form an approximately "V" shape.

12. The container of claim 2, wherein the plurality of lower retention members are resilient, about equally spaced apart rings.

13. The container of claim 12, wherein the rings are aligned in a row along the base of the container.

14. The container of claim 13, wherein the row is located in the center of the base.

15. The container of claim 2, wherein the plurality of lower retention members are a continuous sinusoidal member formed to engage the products.

16. The container of claim 2, wherein the sleeve is a lengthwise channel attached to the outer side wall.

17. The container of claim 2, wherein the stop in the upper rim is a circular indentation toward the distal end of the product container, the stop enabling the container to engage with a prong and to tip.

18. The container of claim 2, wherein the complete product container for displaying products is formed from a sheet of deformable resilient material.

19. The container of claim 18, further comprising a plurality of cuts indicating fold points in the sheet of deformable material.

* * * * *